US008406681B2

(12) United States Patent
Miyake

(10) Patent No.: US 8,406,681 B2
(45) Date of Patent: Mar. 26, 2013

(54) SHEET PROCESSING APPARATUS CAPABLE OF PERFORMING A PUNCH PROCESS AND IMAGE FORMING SYSTEM HAVING SAME

(75) Inventor: Toshiyuki Miyake, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 393 days.

(21) Appl. No.: 12/627,349

(22) Filed: Nov. 30, 2009

(65) Prior Publication Data

US 2010/0158597 A1 Jun. 24, 2010

(30) Foreign Application Priority Data

Dec. 18, 2008 (JP) ..... 2008-322045
Nov. 13, 2009 (JP) ..... 2009-259882

(51) Int. Cl.
*G03G 15/00* (2006.01)
*B65H 33/04* (2006.01)
*B65H 39/00* (2006.01)
*B26D 7/06* (2006.01)

(52) U.S. Cl. ..... 399/407; 399/405; 270/58.08; 270/58.09; 83/76.6

(58) Field of Classification Search ..... 399/407, 399/405, 408, 410; 83/72, 73, 76.1, 76.6, 83/76.7, 76.8, 76.9; 270/58.08, 58.09
See application file for complete search history.

(56) References Cited

U.S. PATENT DOCUMENTS 5,746,162 A * 5/1998 Hosoi et al. ..... 270/37
2008/0246205 A1 10/2008 Fujii et al.
2009/0315246 A1 12/2009 Nishimura et al.

FOREIGN PATENT DOCUMENTS

JP 11-79536 3/1999
JP 11079536 A * 3/1999

* cited by examiner

*Primary Examiner* — Judy Nguyen
*Assistant Examiner* — Justin Olamit
(74) *Attorney, Agent, or Firm* — Fitzpatrick, Cella, Harper & Scinto

(57) ABSTRACT

A sheet processing apparatus includes: a punch portion which is capable of punching a hole of a different type in a sheet; a sheet stack portion on which a punched sheet is stacked; and a determining portion which determines the hole type; wherein stack limit number of sheets to be stacked on the sheet stack portion is changed in accordance with the hole type determined by the determining portion.

12 Claims, 16 Drawing Sheets

*FIG. 12*

| | FOUR HOLES | THIRTY HOLES (CIRCLE) | THIRTY HOLES (SQUARE) |
|---|---|---|---|
| ID | 1 | 2 | 3 |
| HOLE NUMBER | 4 | 30 | 30 |
| HOLE DIAMETER | 8 mm | 6 mm | 6 mm |
| SHAPE | CIRCLE | CIRCLE | SQUARE |

*FIG. 15*

| | | STACK LIMIT NUMBER N |
|---|---|---|
| NO PUNCH SPECIFIED | NO HOLE | 5000 SHEETS |
| ID=1 | FOUR HOLES (CIRCULAR HOLES) | 4500 SHEETS |
| ID=2 | THIRTY HOLES (CIRCULAR HOLES) | 2500 SHEETS |
| ID=3 | THIRTY HOLES (SQUARE HOLES) | 1000 SHEETS |

SHEET PROCESSING APPARATUS CAPABLE OF PERFORMING A PUNCH PROCESS AND IMAGE FORMING SYSTEM HAVING SAME

BACKGROUND OF THE INVENTION

1. Field of the Invention

The present invention relates to a sheet processing apparatus capable of performing a punch process to punch holes in a sheet and an image forming system having the sheet processing apparatus.

2. Description of the Related Art

In the related art, a sheet processing apparatus capable of performing a punch process to punch holes in a sheet has been combined with an image forming apparatus for improving efficiency of operation to keep or use image-formed sheets by binding with a file or a ring.

With such a sheet processing apparatus, a number of sheets which are punched for binding are stacked on a stack tray. However, since burrs may be generated due to the punch process in sheets, there may be a risk that stack error occurs caused by the burrs of holes.

Accordingly, in the related art, there has been proposed a configuration to prevent the stack error caused by the burrs of holes punched in sheets. For example, a configuration to prevent the stack error caused by hole burrs by switching stack limit number of sheets on the stack tray depending on presence of punch process performing is disclosed in Japanese Patent Application Laid-open No. 11-079536. Specifically, the first stack limit number is selected in the case without the punch process performing and the second stack number which is smaller than the first stack limit number is selected in the case with the punch process performing.

Recently, a sheet processing apparatus capable of punching holes of different number, shape and size with the single sheet processing apparatus by replacing a punch for punching has been proposed in order to be ready for a variety of files and rings. When the number, shape and size of the holes punched in the sheets are different, the shape and size of the burrs becomes different even in a case that the punch process is performed in the same manner. Accordingly, stacking ease of the sheets onto the stack tray remarkably varies.

The influence of hole types (i.e., the number, shape and size) to the stacking ease becomes apparent in a case that a large capacity stacker capable of stacking sheets vertically in the order of five thousands on a single horizontal stack tray is combined with the abovementioned sheet processing apparatus.

Accordingly, in the case that there are two stack limit numbers depending on the presence of the punch process performing as described above, the stack limit number must be set within a range to ensure the stacking ease of the hole type of the worst conditions. For example, it is assumed that sheets with two holes can be stacked in a well-aligned manner up to four thousands and the upper limit number of well-aligned stacking of sheets with thirty holes is one thousand. In this case, the stack limit number has to be set to one thousand even for the sheets with two holes. Accordingly, the performance of the large capacity stacker cannot be exploited, so that the stack tray becomes full frequently. Consequently, downtime is increased and usability is decreased. On the contrary, when the stack limit number of sheets with the punch process performing is set to be four thousands which is the upper limit for the sheets with two holes, interference between the burrs and interference between sheet end portions and the burrs occur at the time of stacking the sheets with thirty holes. In addition, the height difference at the upper surface of the sheets occurs due to overlapping of the burrs. Accordingly, the sheet alignment is not maintained and stacking error occurs. In a worse case, there is a risk to cause paper jamming, stack slipping and the like.

SUMMARY OF THE INVENTION

A sheet processing apparatus includes: a punch portion which is capable of punching a hole of a different type in a sheet; a sheet stack portion on which a punched sheet is stacked; and a determining portion which determines the hole type, wherein stack limit number of sheets to be stacked on the sheet stack portion is changed in accordance with the hole type determined by the determining portion.

According to the present invention, the stack number of sheets on the stack portion can be set to appropriate number corresponding to a hole type while maintaining sheet stacking ease even in a case of a different hole type punched in the sheets. Thus, downtime caused by full stacking can be effectively suppressed and decrease in usability can be suppressed as well.

Further features of the present invention will become apparent from the following description of exemplary embodiments with reference to the attached drawings.

BRIEF DESCRIPTION OF THE DRAWINGS

FIG. 12 is a table which indicates punch unit types (number, shape and size of holes);

FIG. 15 is a table which indicates the stack limit number corresponding to presence of the punch process and each hole type.

DESCRIPTION OF THE EMBODIMENTS

In the following, exemplary embodiments of the present invention will be described in detail as examples. Here, dimensions, materials and shapes of structural components and relative arrangement thereof described in the following embodiments may be appropriately modified in accordance with configurations and various conditions of apparatuses to which the present invention is applied. Therefore, unless otherwise specified, it is to be understood that the scope of the present invention is not limited to the description of the following embodiments.

(Whole Configuration of Image Forming System)

Figure 1:
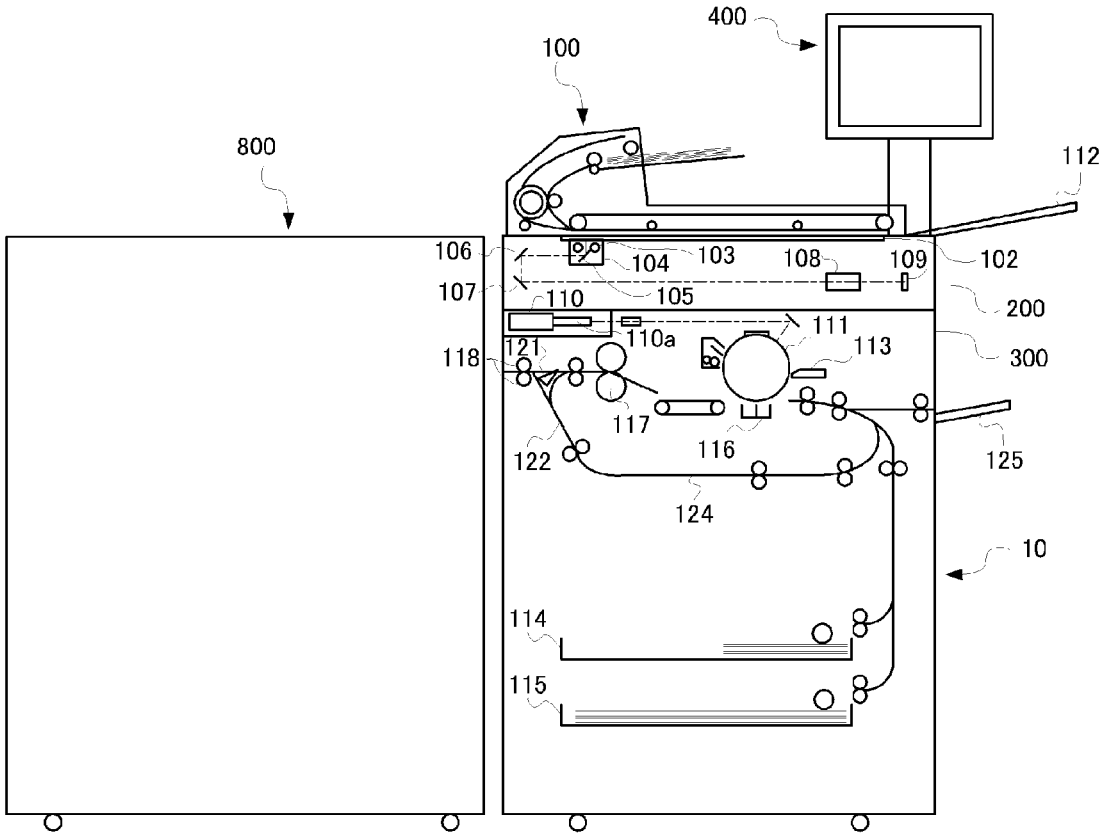
FIG. 1 is a schematic sectional view which illustrates the general configuration of an image forming system.

In the following, an image forming system configured with an image forming apparatus main body and a sheet processing apparatus will be described as an example. FIG. 1 is a schematic sectional view to illustrate a general configuration of the image forming system.

As illustrated in FIG. 1, the image forming system is configured with the image forming apparatus main body 10 and a stacker 800 as the sheet processing apparatus. The image forming apparatus main body 10 includes an image reader 200 to read an image of an original and a printer 300 to record an image on a sheet. Further, the image forming apparatus main body 10 includes an operation displaying unit 400. The stacker 800 is a sheet processing apparatus (i.e., a sheet processing portion) to selectively perform a process against image-formed sheets and stack the sheets.

An original feeding unit 100 is mounted on the image reader 200. In the original feeding unit 100, originals set to be face-up on an original tray are sequentially fed one by one from the top page, and then, discharged toward an external discharge tray 112 after passing through a flow-reading position on a platen glass 102 via a curved path. When the original is passing through the flow-reading position on the platen glass 102, the image of the original is read by a scanner unit 104 which is held at a position corresponding to the flow-reading position. This is a reading method of so-called original flow-reading. Specifically, when the original is passing through the flow-reading position, a lamp 103 of the scanner unit 104 irradiates light on an image surface of the original. Then, reflecting light from the original is guided to a lens 108 via mirrors 105, 106, 107. The light passing through the lens 108 forms an image on an image pickup surface of an image sensor 109.

By conveying the original to pass through the flow-reading position as mentioned above, scanning of reading original is performed as the direction perpendicular to the original conveying direction being a main scanning direction and as the conveying direction being a sub-scanning direction. That is, the reading of the whole original image is performed by conveying the original in the sub-scanning direction while the image sensor 109 reads the original image in the main scanning direction for each line during the original passes through the flow-reading position. The optically read image is converted into image data and output by the image sensor 109. The image data output from the image sensor 109 is input to an exposure controlling portion 110 of the printer 300 as a video signal after receiving a predetermined process at a later-mentioned image signal controlling portion 202.

Here, it is also possible to read the original by scanning with the scanner unit 104 in the sub-scanning direction along the platen glass 102 in a state that the original is stopped at a predetermined position of the platen glass 102 after being conveyed by the original feeding unit 100. This is a reading method of so-called original fixed-reading.

When the original is read without using the original feeding unit 100, first, a user pulls up the original feeding unit 100 and places the original on the platen glass 102. Then, the reading of the original is performed by scanning of the scanner unit 104 in the sub-scanning direction. Namely, when the original is read without using the original feeding unit 100, the original fixed-reading is performed.

At an image forming portion of the printer 300, the exposure controlling portion 110 modulates and outputs laser light based on the input video signal. The laser light is irradiated on a photosensitive drum 111 while being scanned with a polygon mirror 110*a*. An electrostatic latent image is formed on the photosensitive drum 111 in accordance with the scanned laser light. The electrostatic latent image on the photosensitive drum 111 is to be a visible image as a developer image with developer supplied from a development device 113. The image forming portion to form an image on a sheet is configured with the photosensitive drum 111, the exposure controlling portion 110, the development device 113 and the like which are described above.

Further, a sheet is fed from either of cassettes 114, 115, a manual feeding unit 125 or a duplex conveying path 124 at synchronized timing with the irradiation start of the laser light. Then, the sheet is conveyed between the photosensitive drum 111 and a transfer portion 116. The developer image formed on the photosensitive drum 111 is transferred onto the sheet by the transfer portion 116.

The sheet on which the developer image is transferred is conveyed to a fixing portion 117. The fixing portion 117 fixes the developer image on the sheet by applying heat and pressure to the sheet. The sheet passed through the fixing portion 117 is discharged from the printer 300 toward the outside (i.e., the stacker 800) via a switching member 121 and a discharge roller 118.

Here, when the sheet is to be discharged in a state that the image forming surface faces downward (i.e., in a state of face-down), the sheet passed through the fixing portion 117 is once guided to a reversing path 122 by switching operation of the switching member 121. Then, after the rear end of the sheet passes through the switching member 121, the sheet is switched-back and discharged from the printer 300 by the discharge roller 118. In the following, this discharge pattern is called reversed discharge. The reversed discharge is performed in the case of forming images sequentially from a top page, such as forming images read with the original feeding unit 100 or forming images output from a computer. In this case, the order of discharged sheets is to be in correct page order.

On the contrary, when a hard sheet such as an OHP sheet is fed from the manual feeding unit 125 and an image is formed on the sheet, the sheet is discharged by the discharge roller 118 in a state that the image forming surface faces upward (i.e., in a state of face-up) without being guided to the reversing path 122.

Further, in the case that duplex recording to perform image forming on both surfaces of the sheet is set, the sheet is conveyed to the duplex conveying path 124 after being guided to the reversing path 122 by the switching operation of the switching member 121. The sheet guided to the duplex conveying path 124 is fed once more between the photosensitive drum 111 and the transfer portion 116 at the abovementioned timing.

The discharged sheet from the printer 300 is transferred to the stacker 800 and the stacker 800 performs a punch process and a stack process.

(Block Diagram of Image Forming System)

Figure 2:
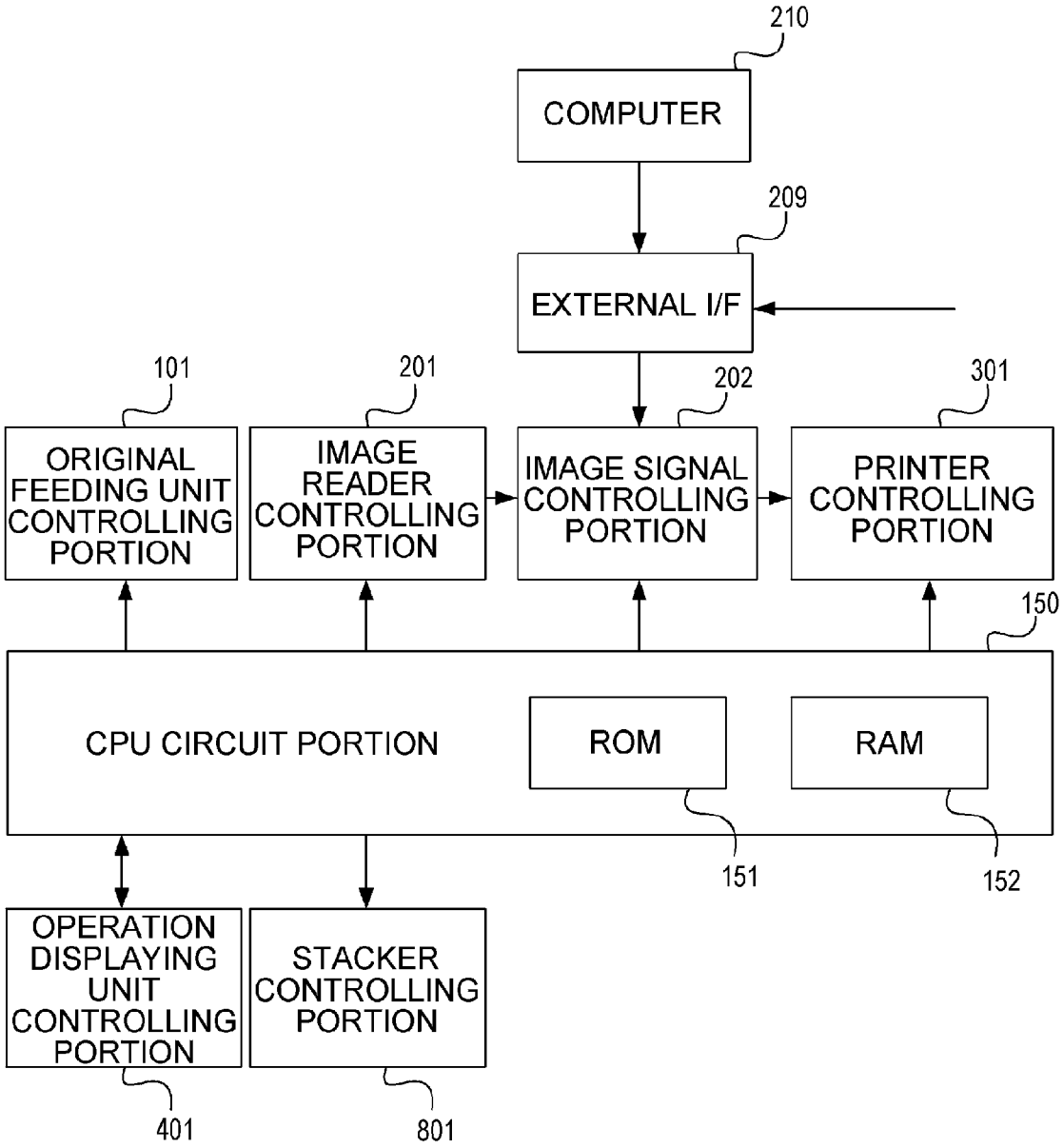
FIG. 2 is a block diagram which illustrates the configuration of a controller to manage controlling of the whole image forming system.

Next, the configuration of a controller to manage control of the whole image forming system will be described with reference to FIG. 2. FIG. 2 is a block diagram illustrating the configuration of the controller to manage the control of the whole image forming system of FIG. 1.

As illustrated in FIG. 2, the controller has a CPU circuit portion 150. The CPU circuit portion 150 incorporates a CPU (not illustrated), a ROM 151 and a RAM 152 and generally controls each of blocks 101, 201, 202, 209, 301, 401, 701 with control programs stored in the ROM 151. The RAM 152 temporally stores control data and is used for an operation area of arithmetic processes accompanied with the control.

An original feeding unit controlling portion 101 performs drive control of the original feeding unit 100 based on instructions from the CPU circuit portion 150. An image reader controlling portion 201 performs drive control of the abovementioned scanner unit 104 and the image sensor 109, and then, transfers an analog image signal output from the image sensor 109 to an image signal controlling portion 202.

The image signal controlling portion 202 performs various processes after converting the analog image signal from the image sensor 109 into a digital signal, and then, outputs the digital signal to a printer controlling portion 301 after converting into a video signal. In addition, the image signal controlling portion 202 performs various processes against a digital image signal input from a computer 210 via an external I/F 209, and then, outputs the digital image signal to the printer controlling portion 301 after converting into a video signal. The process operation of the image signal controlling portion 202 is controlled by the CPU circuit portion 150. The printer controlling portion 301 drives the abovementioned exposure controlling portion 110 based on the input video signal.

An operation displaying unit controlling portion 401 performs exchanging of information with an operation displaying unit 400 and the CPU circuit portion 150. The operation displaying unit 400 includes a plurality of keys to set various functions regarding the image forming and a displaying portion to display information indicating setting conditions. The operation displaying unit 400 outputs a key signal corresponding to each key operation to the CPU circuit portion 150 and displays corresponding information based on the signal from the CPU circuit portion 150 at the displaying portion.

A stacker controlling portion 801 is mounted on the stacker 800 and performs drive control of the whole stacker 800 by exchanging information with the CPU circuit portion 150. Details of this control will be described later.

(Operation Displaying Portion)

Figure 5:
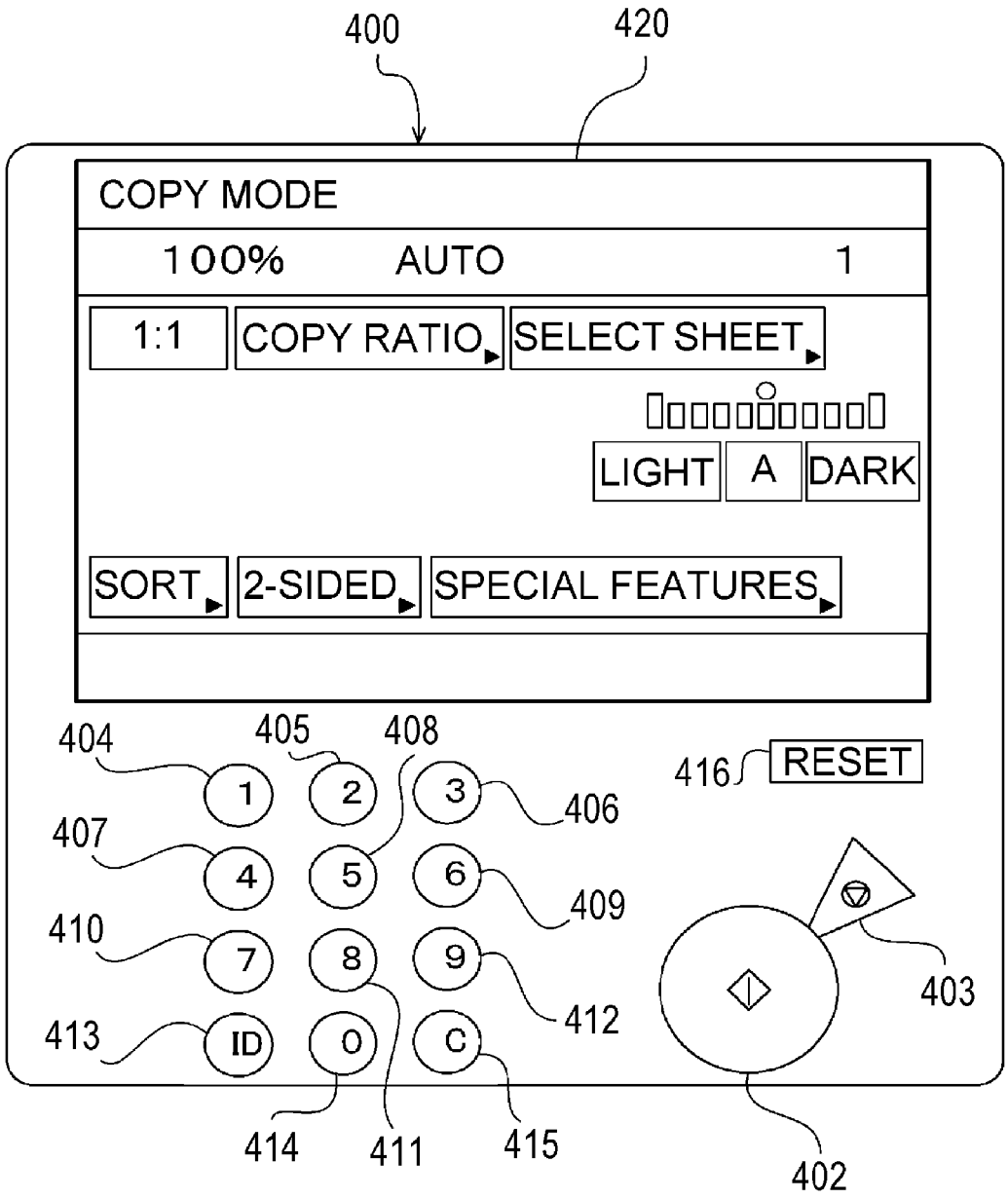
FIG. 5 is a plane view which illustrates an operation displaying portion of the image forming system.

FIG. 5 is a view to illustrate the operation displaying unit 400 of the image forming system of FIG. 1.

At the operation displaying unit 400, there are arranged a start key 402 to start the image forming operation, a stop key 403 to interrupt the image forming operation, a ten key 404 to 412, 414 to perform setting of number placing, an ID key 413 to perform user authentication, a clear key 415 and a reset key 416. In addition, a liquid-crystal displaying portion 420 having a touch panel is arrange at the upper part thereof so that soft keys can be formed on the screen.

The image forming system has a non-sort process, a sort process and a punch process as process modes. Setting of the process mode is performed by input operation from the operation displaying unit 400. For example, at the time of setting the process mode, when a soft key of "SORT" is selected on an initial screen of FIG. 5, a menu selection screen is displayed at the liquid-crystal displaying portion 420 and the setting of the process mode is performed by utilizing the menu selection screen.

(Block Diagram of Stacker)

Figure 4:
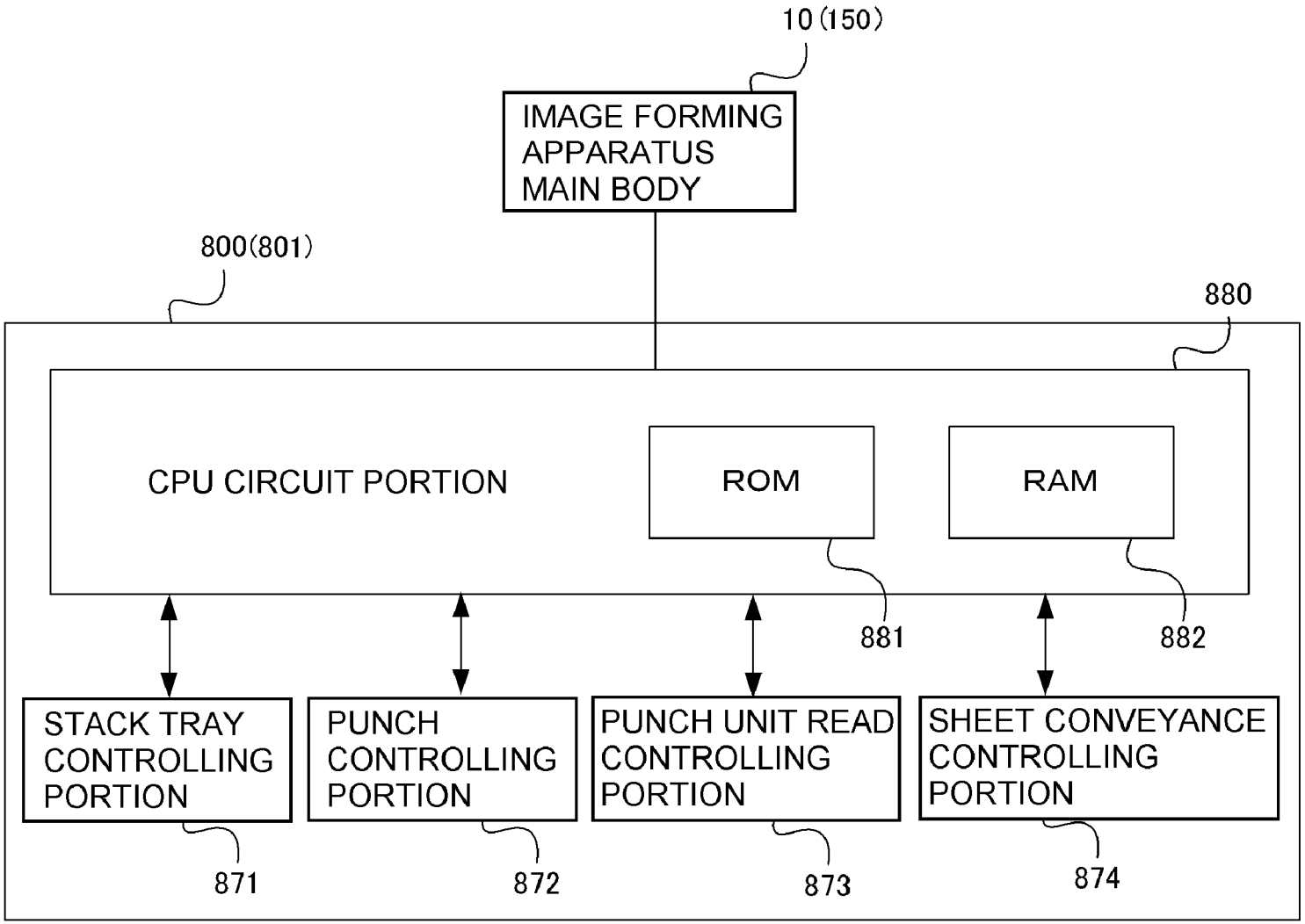
FIG. 4 is a block diagram which illustrates the configuration of a stacker controlling portion to control the stacker.

Next, the configuration of the stacker controlling portion 801 to perform drive control of the stacker 800 will be described with reference to FIG. 4. FIG. 4 is a block diagram to illustrate the configuration of the stacker controlling portion 801 of FIG. 2.

As illustrated in FIG. 4, the stacker controlling portion 801 is configured with a CPU circuit portion 880, a ROM 881, a RAM 882 and the like. The CPU circuit portion 880 performs data exchange while communicating with the CPU circuit portion 150 which is arranged at the image forming apparatus main body 10. Then, the CPU circuit portion 150 generally controls each of blocks 871, 872, 873, 874 of the stacker 800 by executing various programs stored in the ROM 881 based on the instructions from the CPU circuit portion 150.

A stack tray controlling portion 871 controls lifting and lowering of a stack tray 821 based on input from a sheet surface detecting sensor 816 and the like. A punch controlling portion 872 controls a punch processing unit 850 to perform a punch process in the sheets. A punch unit read controlling portion 873 controls an IC tag reader 870 to read out information stored in an IC tag 868 of the punch unit. A sheet conveyance controlling portion 874 performs sheet conveying control by rotating conveying rollers arranged between a sheet entrance portion 811 and a conveying path 814 with motors (not illustrated).

(Stacker)

Figure 3:
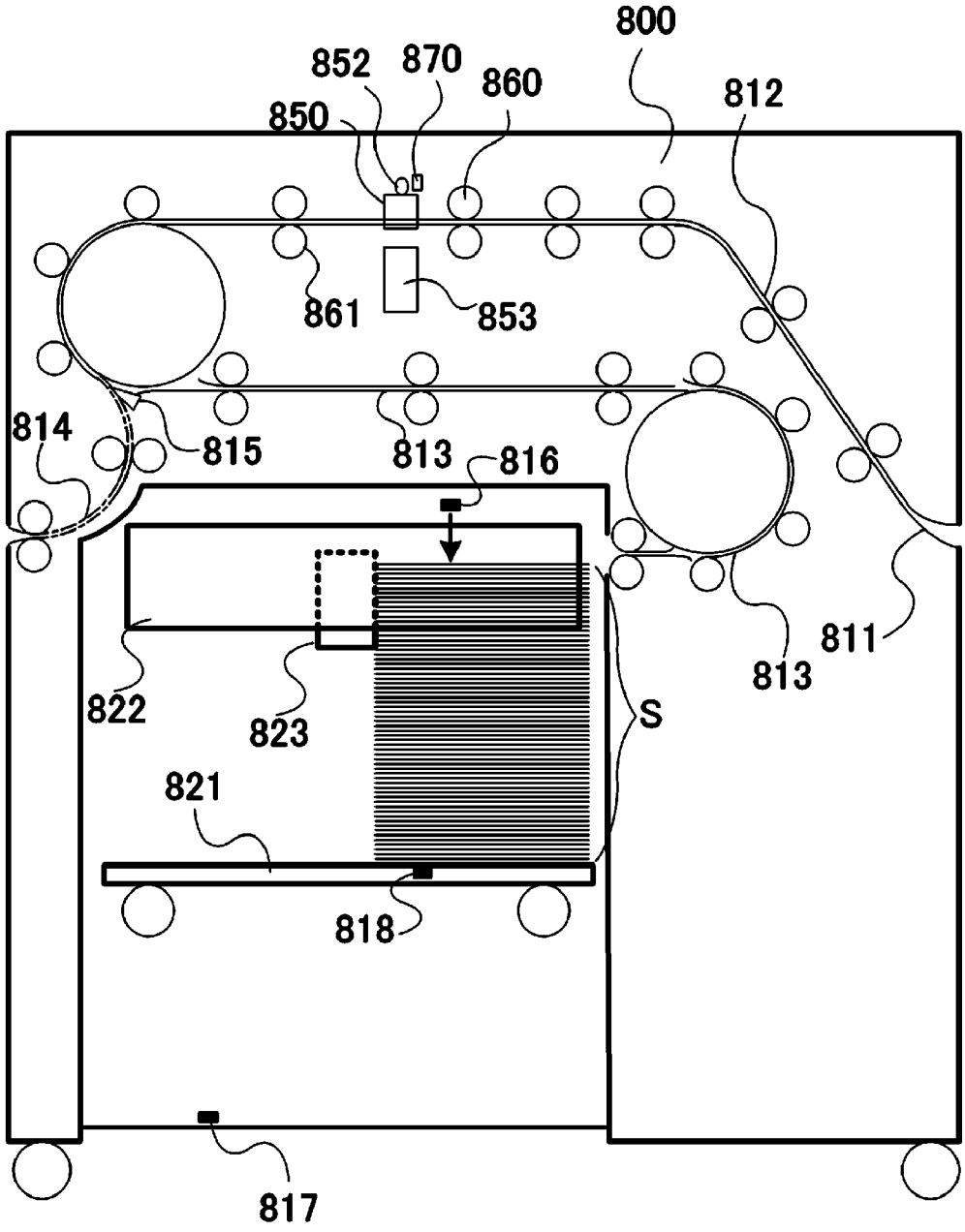
FIG. 3 is a schematic sectional view which illustrates the configuration of a stacker.

Next, the configuration of the stacker 800 will be described with reference to FIG. 3. FIG. 3 is a schematic sectional view to illustrate the configuration of the stacker 800 of FIG. 1. The stack tray 821 is a sheet stack portion to perform stacking while taking sheets S discharged from the image forming apparatus main body 10 sequentially into the stacker 800. The stack tray 821 is lifted and lowered by a motor (not illustrated). A sheet restricting member 822 movable in the width direction (i.e., the front-rear direction) which is perpendicular to the sheet conveying direction restricts the sheet end portions in the width direction. A sheet restricting member 823 movable in the sheet conveying direction restricts the sheet end portions in the sheet conveying direction. The sheet restricting members 822, 823 respectively driven by a motor (not illustrated) is to improve stacking ease of the sheets on the stack tray 821.

The sheet discharged from the image forming apparatus main body 10 is took into the stacker 800 via the sheet entrance portion 811. A conveying path 812 (i.e., the conveying route) is to convey the sheet to the stack tray 821 of the stacker 800 or to the conveying path 814 which guides to a device connected to the downstream of the stacker 800.

Further, the punch processing unit 850 as a perforating unit to perform a punch process against the sheets is arranged at a midpoint of the conveying route of the conveying path 812. The punch processing unit 850 is capable of punching holes of different size in the sheets by replacing a later-mentioned punch unit. When the punch process is specified as the process mode at the operation displaying unit 400 and the job is started, the punch processing unit 850 performs the punch process against the passing sheet.

Figure 7A:
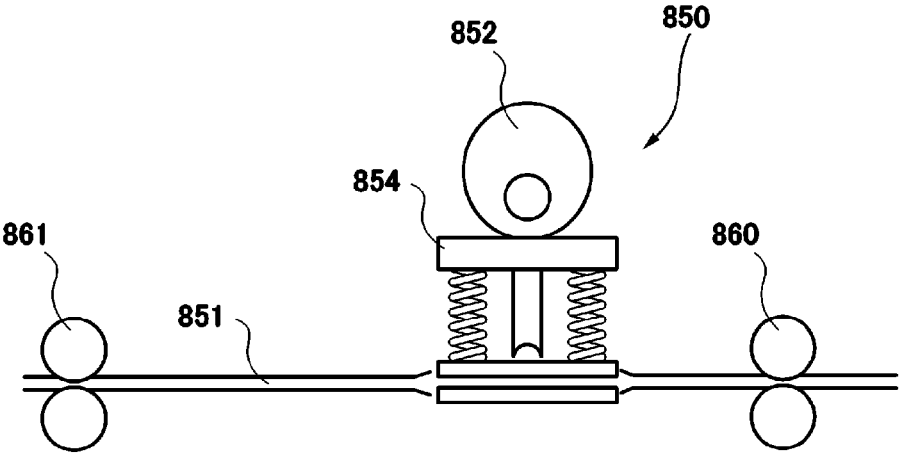
FIGS. 7A to 7C are explanatory views for a punch process at a punch processing unit.
Figure 7B:
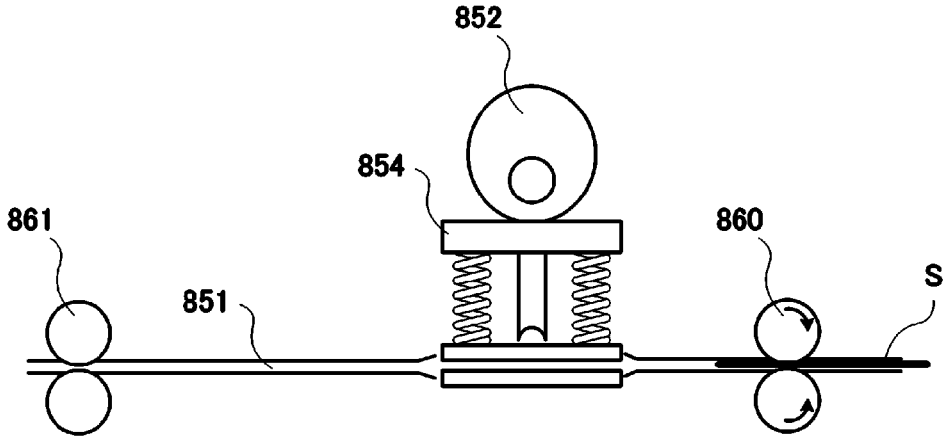
Figure 7C:
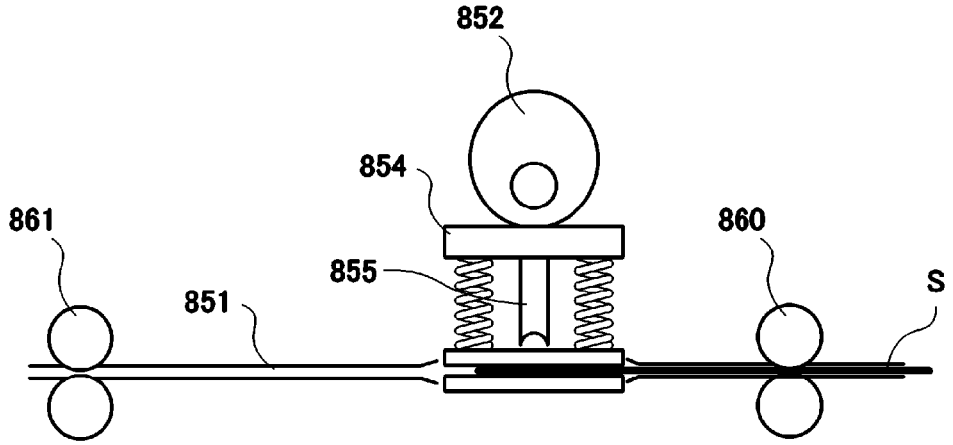

As illustrated in FIGS. 7A to 7C, the punch processing unit 850 is configured with a punch conveying path 851, the punch unit 854, a cam 852, a conveying roller 860, a conveying roller 861 and a punched burr accommodating box 853. Then, the punch processing unit 850 is controlled by a punch controlling portion 872 of FIG. 4.

Figure 6:
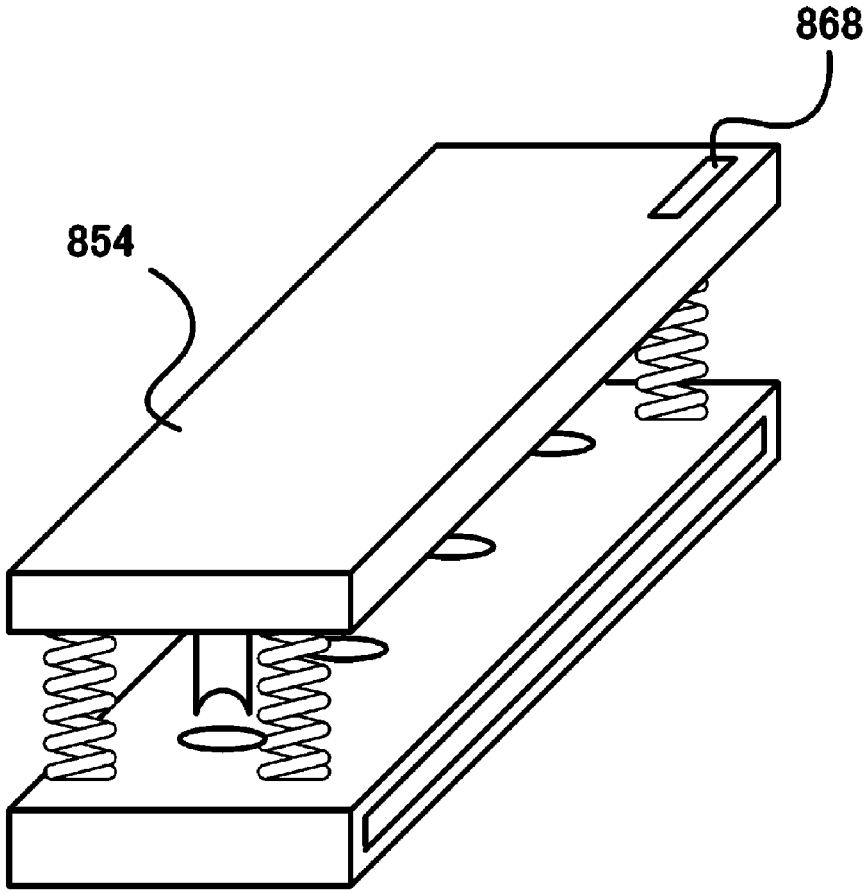
FIG. 6 is a perspective view which illustrates a punch unit.

FIG. 6 is a perspective view of the punch unit 854 mounted detachably attachable to the punch processing unit 850. The punch unit 854 has a punch and a die to make a hole in the sheet. The punch process is performed by pressing the punch of the punch unit 854 toward the die when the sheet passes. The punch unit 854 is replaceable. The punch units for a variety of hole types are prepared so as to be capable of changing the hole type (i.e., the number, shape and size) by replacing the punch unit 854.

Further, a non-contact communication IC chip 868 (hereinafter, the IC tag) of a passive-tag type with an antenna is mounted at the upper portion of the punch unit 854. The IC tag 868 has information of the punch unit 854 including information for determination of the hole type. Due to communication between the IC tag 868 and a non-contact communication IC reading unit 870 (i.e., the IC tag reader) of FIG. 3, the punch unit information is possible to be determined by the punch unit read controlling portion 873 (i.e., the determining portion) of FIG. 4. Here, the punch unit type is determined by utilizing the non-contact communication IC. However, the information format to determine the hole type is not limited to this. For example, it is also possible to communicate with the IC tag of the punch unit by wired connection such as drawer not by non-contact communication. Further, it is also possible to perform determining of the hole type by detecting a notch of a flag with an optical sensor which is arranged at the punch processing unit 850 while forming the flag at a part of the punch unit without utilizing a communication portion.

Figure 9:
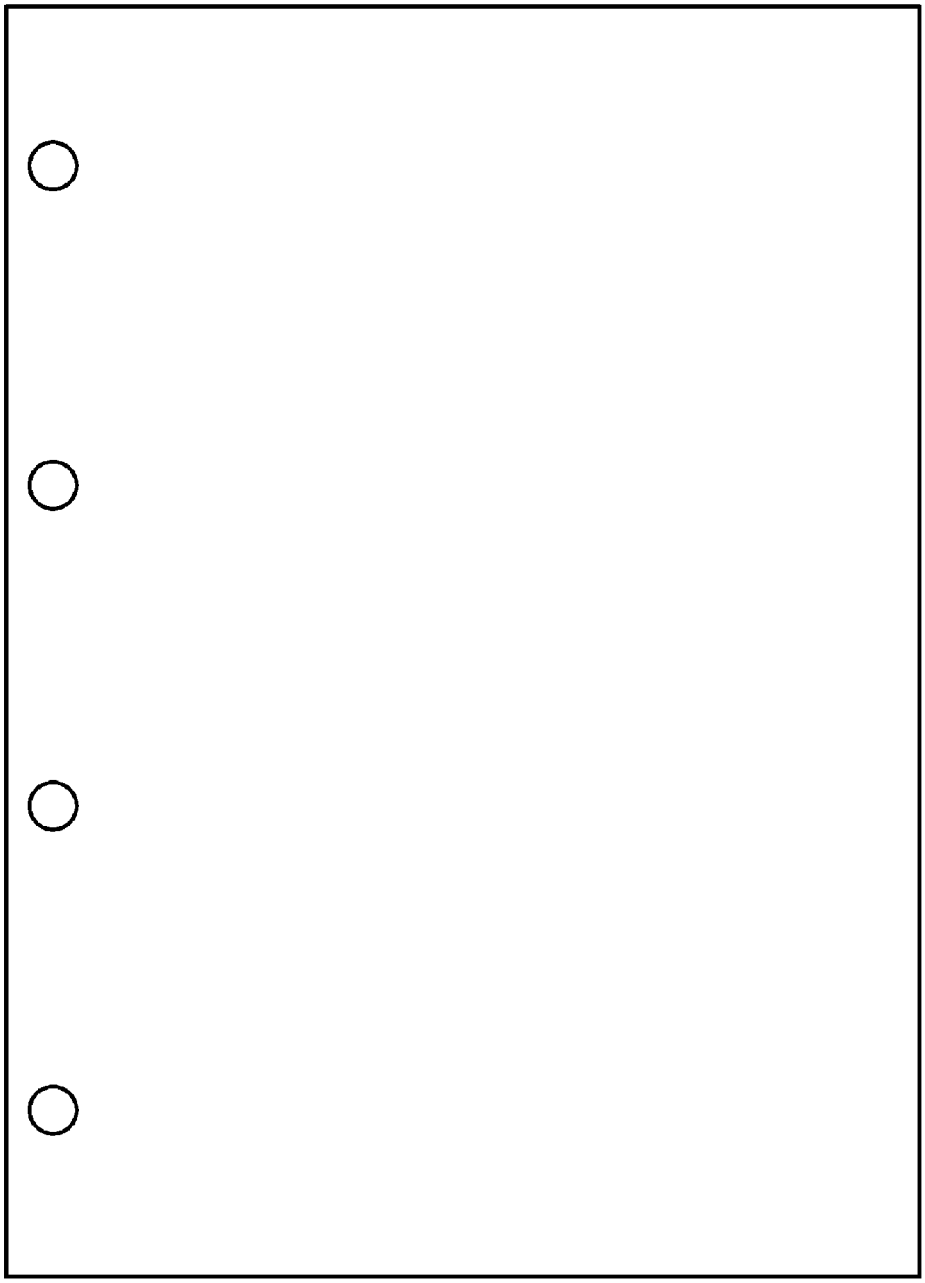
FIG. 9 is a plane view which illustrates a sheet after the punch process of four holes is performed.
Figure 10:
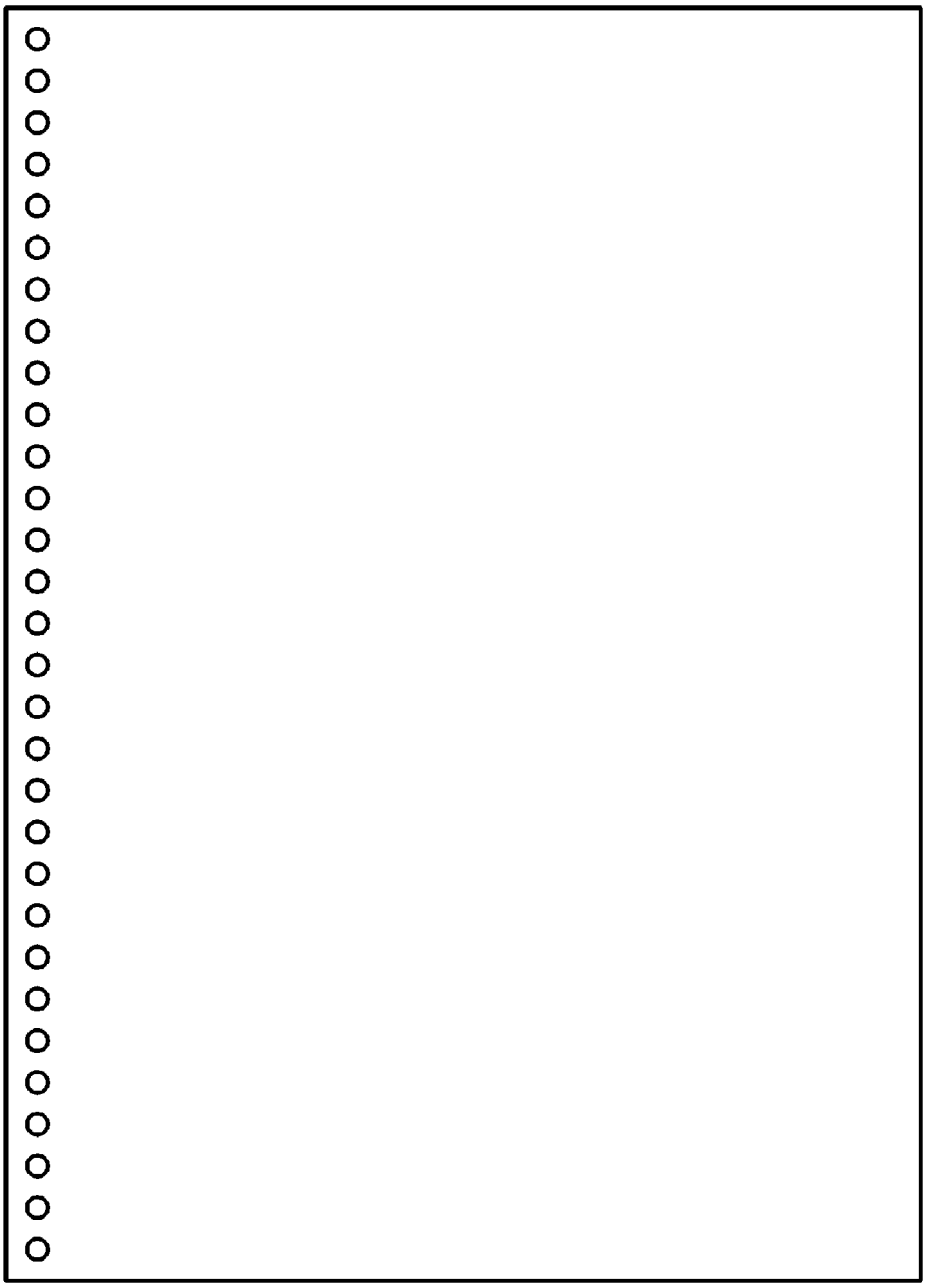
FIG. 10 is a plane view which illustrates a sheet after the punch process of thirty circular holes is performed.
Figure 11:
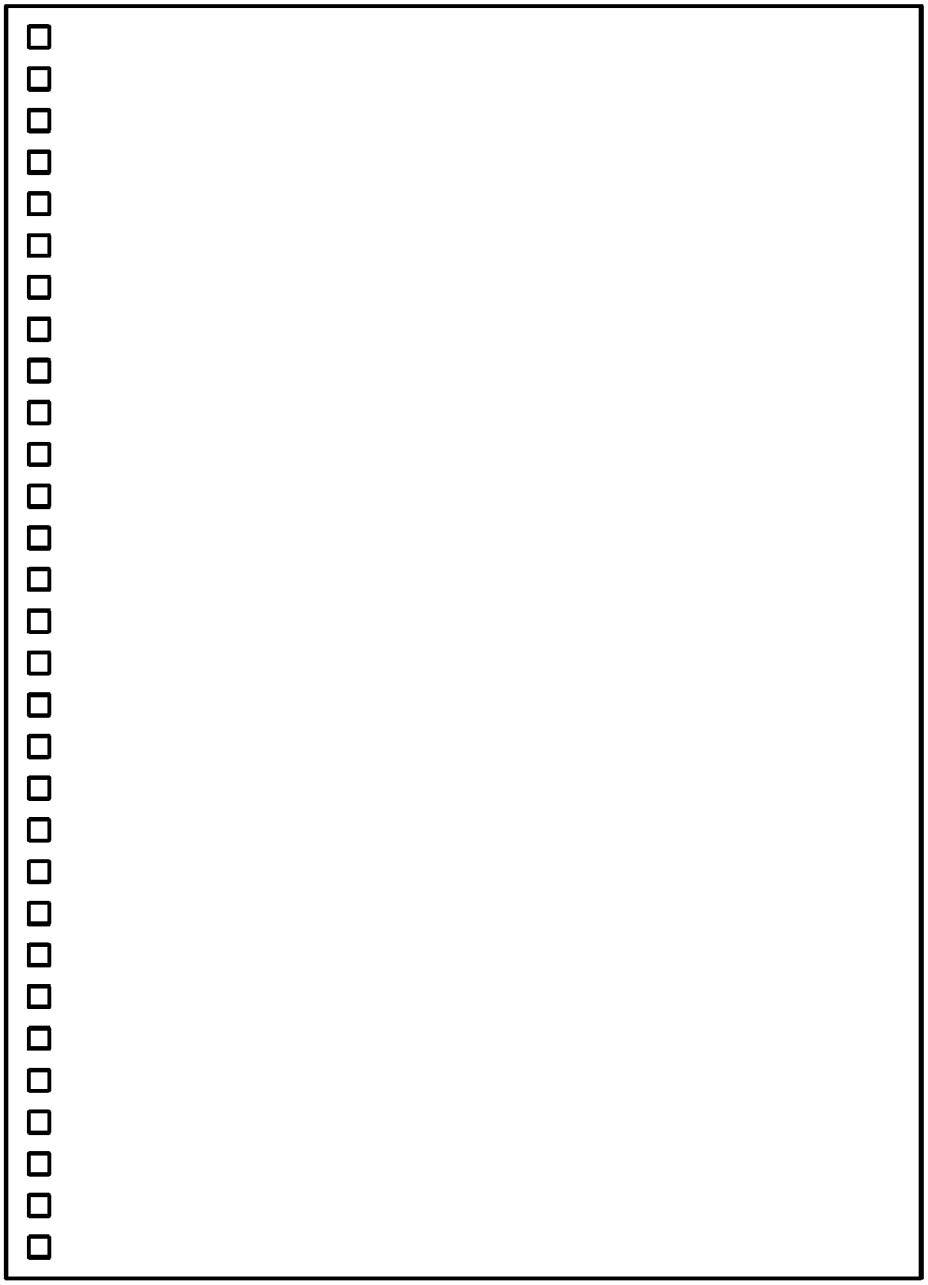
FIG. 11 is a plane view which illustrates a sheet after the punch process of thirty square holes is performed.
Figure 13A:
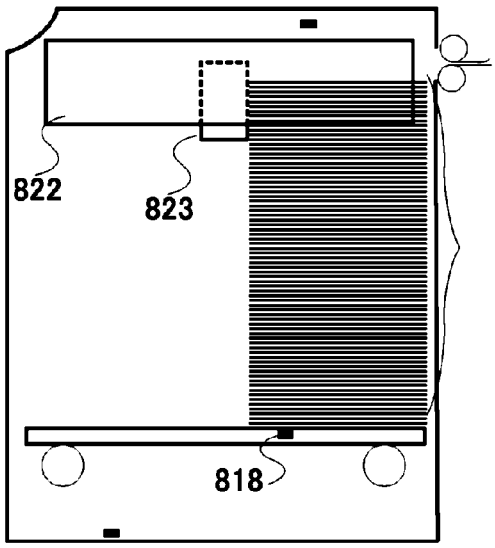
FIGS. 13A to 13D are explanatory views for respective sheet stacking after the punch process is performed.
Figure 13C:
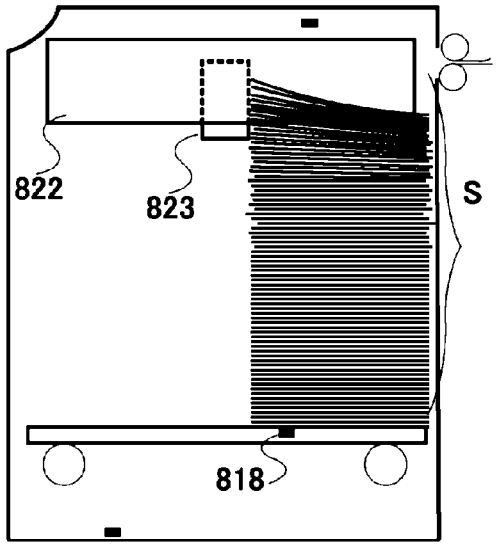
Figure 13B:
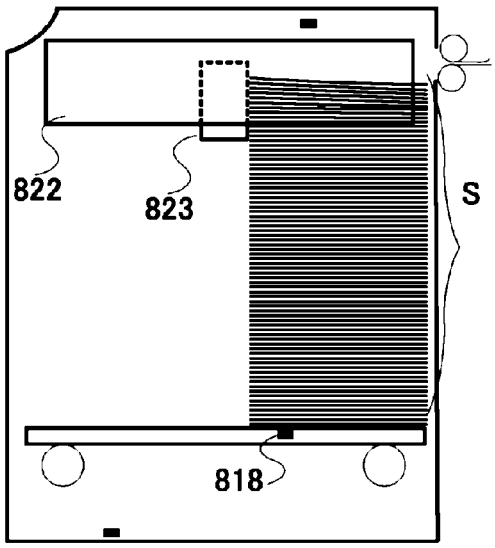
Figure 13D:
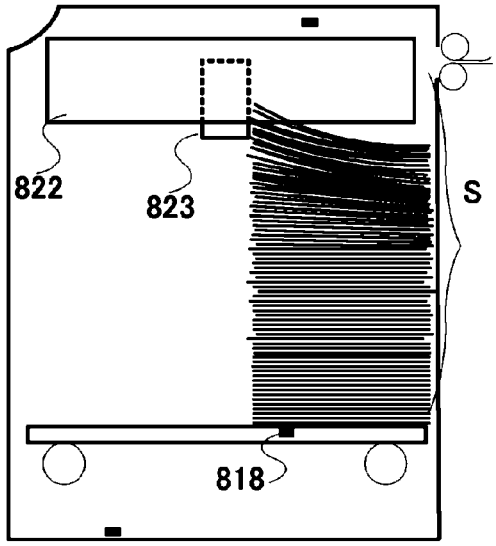

Here, four circular holes, thirty circular holes and thirty square holes are listed as the punch unit types. FIGS. 9 to 11 illustrate the sheet respectively punched by each of the above-mentioned punch units. FIG. 9 is a plane view of the sheet punched by the punch unit of four circular holes. FIG. 10 is a plane view of the sheet punched by the punch unit of thirty circular holes. FIG. 11 is a plane view of the sheet punched by the punch unit of thirty square holes. The sheets of FIGS. 10 and 11 respectively have the same hole number and hole intervals but different hole shape. The punch unit type is defined by a pair of the number and shape of punch holes.

The punch unit information is described in FIG. 12 as an example. Here, the example provides an ID (i.e., identification number), the hole number (i.e., the number of holes), the hole diameter (i.e., the size of holes) and the shape (i.e., the shape of holes). For example, "four holes" is defined as the ID being "1", the hole number being "4", the hole diameter being "8 mm" and the shape being "Circle".

When the punch unit 854 is attached to the punch processing unit 850, the attaching is detected by a punch unit presence detecting sensor (not illustrated). Accordingly, the punch unit read controlling portion 873 performs reading of the punch unit information (i.e., the IC tag 868) with the IC tag reader 870 and stores the information in the RAM 882.

The punch process performed at the punch processing unit 850 when the punch process is specified as the process mode at the operation displaying unit 400 will be described with reference to FIGS. 7A to 7C and 8A to 8C. As illustrated in FIG. 7A, at an initial state of the punch processing unit 850 without the sheet passing, the cam 852 remains stopped at a position of not pressing the punch unit 854 (hereinafter, called the home position). The home position of the cam 852 is detected by a home position sensor (not illustrated). The cam 852 and the conveying rollers 860, 861 of the punch processing unit 850 are respectively driven by a motor (not illustrated). A punch portion is composed of the punch unit 854, the cam 852, and the conveying rollers 860, 861.

As illustrated in FIG. 7B, the sheet S is guided to the punch conveying path 851 by the conveying roller 860. Then, as illustrated in FIG. 7C, the rotation of the conveying roller 860 is stopped to stop the sheet S at a position so that the punch position of the sheet S and the center of the punch 855 of the punch unit 854 are overlapped, according to a conveying path sensor (not illustrated).

Figure 8A:
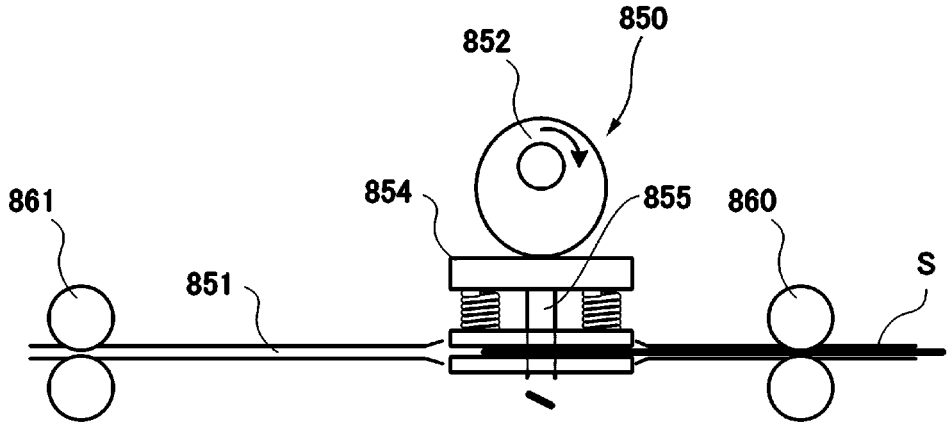
FIGS. 8A to 8C are explanatory views for the punch process at the punch processing unit.
Figure 8B:
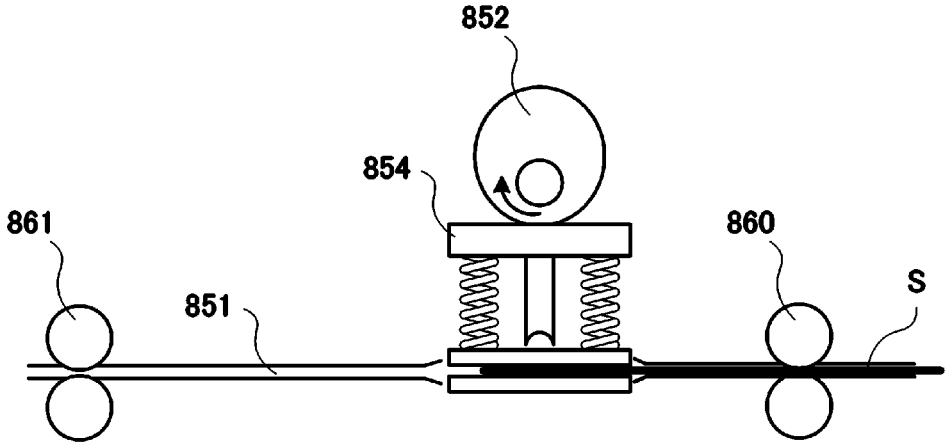
Figure 8C:
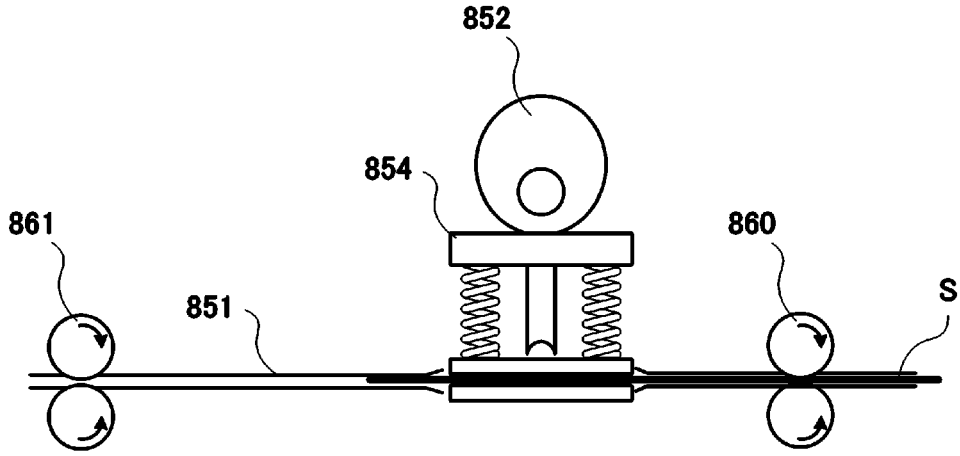

After the sheet S is stopped, the punch 855 of the punch unit 854 is pressed by rotating the cam 852, and then, holes are punched in a top end portion of the sheet S, as illustrated in FIG. 8A. Hole-shaped sheet burrs generated at that time fall into and are accommodated by the punch burr accommodating box 853 of FIG. 3. As illustrated in FIG. 8B, the cam 852 is stopped when the cam 852 returns to the home position after rotation of one turn. After the cam 852 is stopped, the conveying rollers 860, 861 are started to be rotated so that the sheet conveying is restarted, as illustrated in FIG. 8C.

As illustrated in FIG. 3, a conveying path 813 is for sheet stacking utilized in a case that the discharged sheet from the image forming apparatus main body 10 is stacked on the stack tray 821 via the conveying path 812. The conveying path 814 is for discharging to a downstream device utilized in a case that the discharged sheet from the image forming apparatus main body 10 is discharged to the downstream device without being stacked on the stack tray 821 via the conveying path 812. Since a device is not connected to the downstream side of the stacker 800, the conveying path 814 is not used.

A switching member 815 is a switching member to switch the sheet conveying route to the conveying path 813 for sheet stacking or the conveying path 814 for discharging to the downstream device. The sheet surface detecting sensor 816 is an upper surface detecting sensor to detect the top upper surface of the sheets stacked on the stack tray 821. The sheet surface detecting sensor 816 is used to maintain the stack tray 821 at a sheet receiving position with a motor (not illustrated) when the sheets are sequentially stacked on the stack tray 821. A stack tray lower limit detecting sensor 817 is used when the stack tray 821 is lowered to a sheet ejecting position as described later. A sheet presence detecting sensor 818 is used to determine whether or not a sheet is stacked on the stack tray 821.

In the case that the sheet is discharged from the image forming apparatus main body 10, size information of the sheet to be discharged is transmitted from the image forming apparatus main body 10 to the stacker 800. In accordance with the sheet size information, the sheet restricting member 822 to restrict the position of the end portion in the sheet width direction and the sheet restricting member 823 to restrict the position of the end portion in the sheet conveying direction are adjusted to the sheet size. Thus, the sheets can be sequentially stacked on the stack tray 821 in an aligned manner.

When stacked sheet number reaches stack limit number N which is previously set or when the stack tray 821 reaches the stack tray lower limit detecting sensor 817 as the sheets are sequentially stacked on the stack tray 821, it is determined to be stack-number-over. Here, the stack limit number N is to be five thousands at maximum. Details of the stack limit number N will be described later.

When the stack-number-over is detected, the CPU circuit portion 880 of the stacker 800 notifies the CPU circuit portion 150 of the image forming apparatus main body 10. Then, the CPU circuit portion 150 of the image forming apparatus main body 10 continues the operation until the fed sheet at that time is stacked on the stack tray 821 and temporally stops the image forming process thereafter.

In order to eject the sheets stacked on the stack tray 821, the stack tray 821 is moved to the sheet ejecting position by the motor (not illustrated). The stack tray 821 has a caster (not illustrated). For lowering the stack tray 821, when the track tray 821 is driven by a predetermined amount after being detected by the stack tray lower limit detecting sensor 817, the bottom surface of the caster contacts a floor surface and the lowering of the stack tray 821 is stopped.

(Setting of Stack Limit Number)

Setting of the stack limit number of the sheets for the stack tray 821 of the stacker 800 will be described with reference to FIGS. 13A to 13D, 14 and 15 and a flowchart of FIG. 16.

Figure 14:
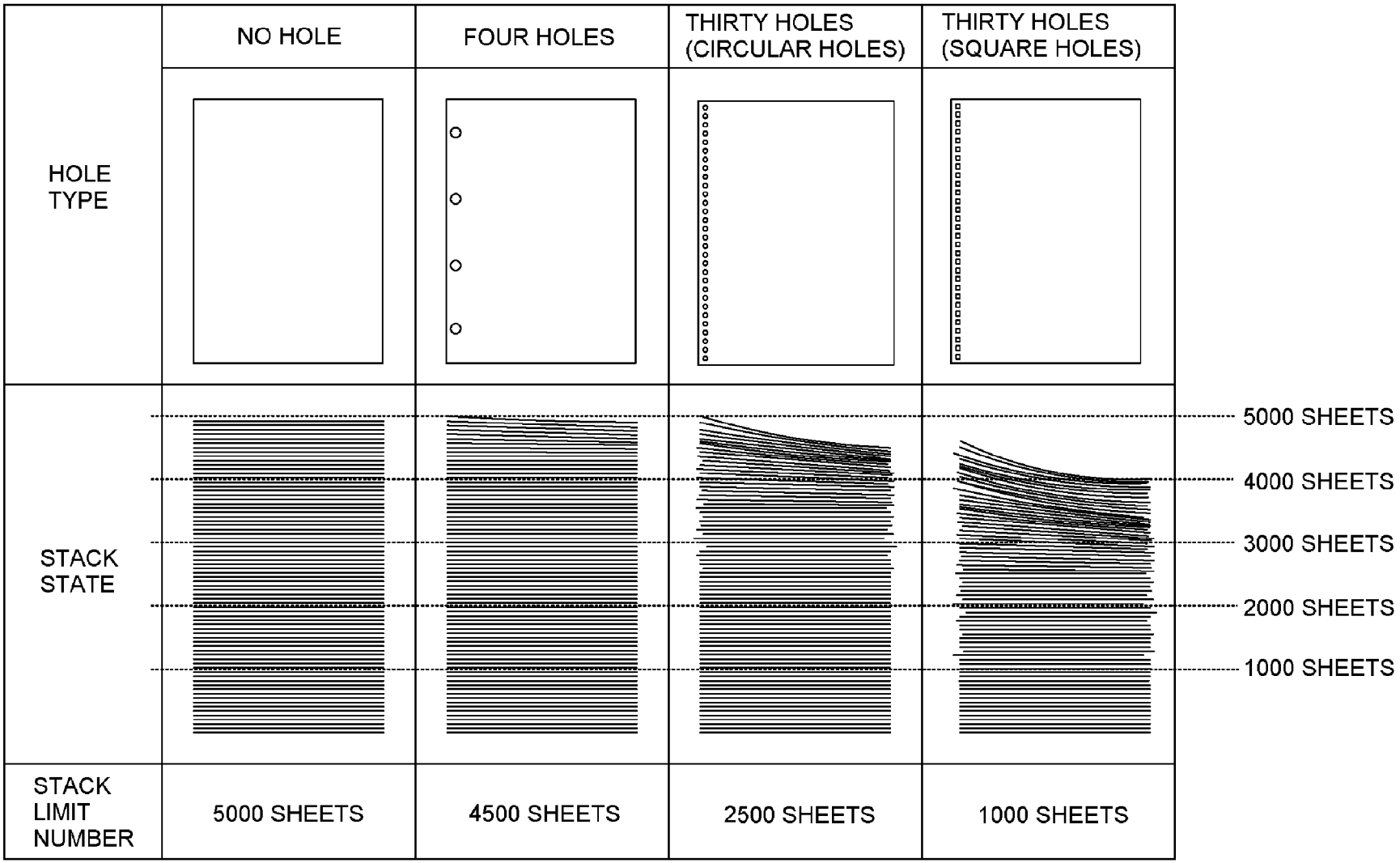
FIG. 14 is an explanatory view for stack limit number corresponding to each hole type.

FIGS. 13A to 13D respectively illustrate a stack state on the stack tray 821 in a case that stacking is continued with the sheets which respectively receive a process of no-punch, four circular holes, thirty circular holes or thirty square holes without setting the stack limit number N. As illustrated in FIG. 14, the larger the hole number is, the more the burrs are apt to be generated. Further, the burrs are more apt to be generated with the circular holes than the square holes. Therefore, the stacking ease on the stack tray 821 is remarkably affected by the above.

In the following, it is described how the generation of the burrs differs by the difference of the punch hole types such as the number, shape and size. Concerning the hole size, in the condition that the pressing force of the punch to press toward the die is the same, cutting is to be difficult when the hole size is small. This is because the pressure is applied not only to the punching edge but also to the whole area of the inside of the punching edge. On the contrary, when the hole size is large, cutting is to be easy since the pressure is concentrated at the part of the punching edge. Namely, the smaller the hole size is (i.e., the more cutting is difficult), the more the burrs are apt to be generated. Concerning the hole shape, square holes are difficult to be punched since the punching edge has edges at corners of intersecting of straight lines. Therefore, the burrs are more apt to be generated compared to the punching edge of seamless circular holes. Then, concerning the hole number, the larger the hole number is, the narrower the intervals of the adjacent holes are. Accordingly, similar to the case that the hole size is small, punch load is to be large and cutting is to be difficult. Therefore, the larger the hole number is, the more the burrs are apt to be generated.

To address this issue, the stack limit number with the punch process is set as follows against the stack limit number (i.e., five thousands) without the punch process. Namely, the possible stack number of being stable is set to forty-five hundreds in a case of four circular holes, to thirty-five hundreds in a case of thirty circular holes and to twenty-five hundreds in a case of thirty square holes. The ROM 881 has a table of the stack limit number N as indicated in FIG. 15. Referring to this table, the CPU circuit portion 880 changes (i.e., sets) the stack limit number N in accordance with the type (i.e., the number, shape and size of the holes) of the punch unit 854.

Figure 16:
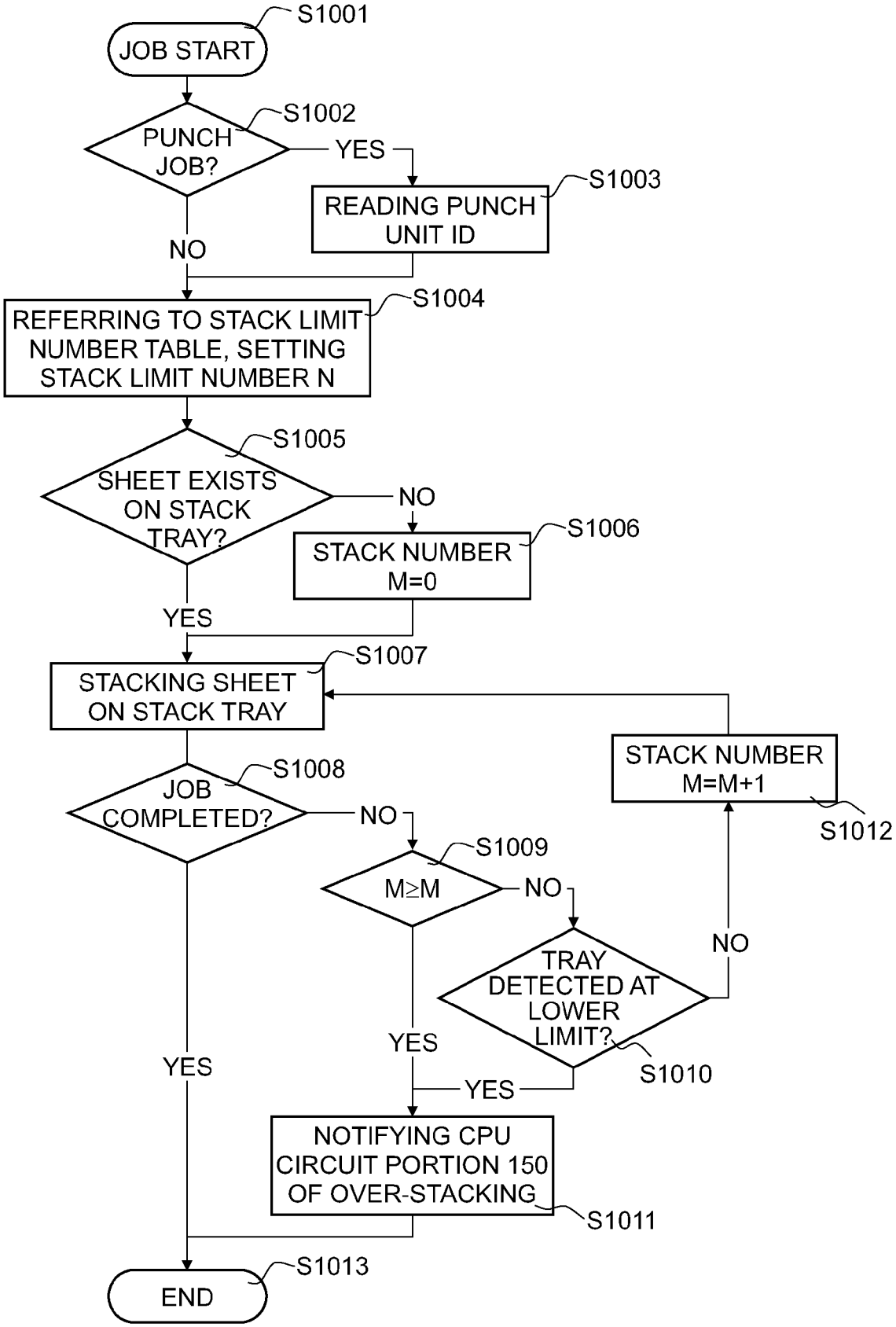
FIG. 16 is a flowchart which describes job flow of the stacker.

In the flowchart of FIG. 16, when the job is started (S1001), the CPU circuit portion 880 of the stacker 800 obtains job information through communication with the CPU circuit portion 150 of the image forming main body 10. Then, when the job information is not for a punch job (S1002), the process proceeds to S1004. On the other hand, when the job information is for the punch job (S1002), the IC tag reader 870 reads the ID of the punch unit 854 which is attached to the punch processing unit 850 and the ID is stored in the RAM 882. Then, the process proceeds to S1004.

Subsequently, the CPU circuit portion 880, serves as a controlling portion, refers to the stack limit number table of FIG. 15 and sets the stack limit number N (S1004). Here, in the case of not being the punch job, the stack limit number N is set to be five thousands (S1004). Meanwhile, in the case of the punch job, the limit number corresponding to the ID stored in the RAM 882 is set as the stack limit number N (S1004). The stack limit number with the punch process to be stacked on the stack tray 821 is smaller than the stack limit number without the punch process. Here, when a sheet is not detected on the stack tray 821 by the sheet presence detecting sensor 818 (S1005), a stack number counter M stored in the RAM 882 is reset to zero (S1006).

The sheet is received from the image forming apparatus main body 10 and conveyed so as to be sequentially stacked onto the stack tray 821 (S1007). When the job is completed before reaching the stack limit number N (S1008), the CPU circuit portion 808 completes the stack process at that time and stops the operation of the stacker 800. When the stack number counter M reaches the stack limit number N (S1009), the CPU circuit portion 808 determines that the stack tray 821 is over-stacked, and notifies the CPU circuit portion 150 of the over-stacking (S1011). Then, the CPU circuit portion 880 stops the job (S1013). When the stack tray 821 is detected to reach the lower limit by the stack tray lower limit detecting sensor 817 before reaching the stack limit number N (S1010), the CPU circuit portion 880 determines that the stack tray 821 is stack over as well. Then, the CPU circuit portion 880 notifies the CPU circuit portion 150 of the stack over (S1011) and stops the job (S1013). The stacking onto the stack tray 821 is continued until the job is stopped.

In a case that the job is not completed (S1008), it is determined whether the stack number counter M reaches the stack limit number N (S1009). When not reaching the stack limit number N, the stack number counter M is incremented for each stacking of one sheet (S1012) until the lower limit of the stack tray 821 is detected by the stack tray lower limit detecting sensor 817 (S1010). Then, the stacking onto the stack tray 821 is continued.

As described above, in the present embodiment, the sheet stack number on the stack tray can be set (i.e., changed) to the appropriate number in accordance with the hole type while maintaining stacking ease of the sheets even in a case with different type of punched holes of the sheets. Accordingly, downtime caused by full stacking can be effectively suppressed and decrease in usability can be suppressed as well.

In the abovementioned embodiment, the configuration to read the information from the IC tag 868 included in the punch unit 854 by utilizing the IC tag reader 870 and to determine the hole type by the punch unit read controlling portion 873 as the determining portion is described as an example. However, not limited to this, it is also possible to determine the hole type (i.e., the number, shape and size) by directly detecting the punched hole of the sheet by a sensor or a CCD without determining the punch unit type.

Further, in the abovementioned embodiment, the configuration to punch a plurality of holes at once by the punch unit is described as an example. However, not limited to this, it is also possible to punch holes from one end side to the other end side of the sheet in a proceeding manner by arranging two cams respectively having a different phase in the axial direction, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-322045, filed Dec. 18, 2008, and No. 2009-259882, filed Nov. 13, 2009, which are hereby incorporated by reference herein in their entirety.

What is claimed is:

1. A sheet processing apparatus comprising:

a punch portion which is capable of punching a hole of a different type in a sheet;

a sheet stack portion on which a punched sheet is stacked;

a determining portion which determines the hole type by at least one of number, shape and size of a hole; and a controlling portion which sets a stack limit number of sheets to be stacked on the sheet stack portion so that the stack limit number of sheets is changed in accordance with the hole type determined by the determining portion.

2. The sheet processing apparatus according to claim 1, wherein the punch portion changes the hole type by replacing a replaceable punch unit to punch a hole in the sheet.

3. The sheet processing apparatus according to claim 2, wherein the punch unit includes information to determine the hole type; and the determining portion determines the hole type from the information included in the punch unit.

4. The sheet processing apparatus according to claim 1, wherein the controlling portion sets the stack limit number of sheets so that the stack limit number of sheets at a time when a number of the holes is larger than a predetermined number is smaller than that at a time when the number of the holes is smaller than or equal to the predetermined number.

5. The sheet processing apparatus according to claim 1, wherein the controlling portion sets the stack limit number of sheets so that the stack limit number of sheets at a time when a shape of the hole is square is smaller than that at a time when the shape of the hole is circular.

6. The sheet processing apparatus according to claim 1, wherein the controlling portion sets the stack limit number of sheets so that the stack limit number of sheets at a time when a size of the hole is small than or equal to a predetermined size is smaller than that at a time when the size of the hole is larger than the predetermined size.

7. An image forming system comprising:

an image forming portion which forms an image on a sheet; and a sheet processing portion which selectively performs a process against the image-formed sheet and stacks the sheet;

wherein the sheet processing portion includes:

a punch portion which is capable of punching a hole of a different type in a sheet;

a sheet stack portion on which a punched sheet is stacked;

a determining portion which determines the hole type by at least one of number, shape and size of a hole; and a controlling portion which sets a stack limit number of sheets to be stacked on the sheet stack portion so that the stack limit number of sheets is changed in accordance with the hole type determined by the determining portion.

8. The image forming system according to claim 7, wherein the punch portion changes the hole type by replacing a replaceable punch unit to punch a hole in the sheet.

9. The image forming system according to claim 8, wherein the punch unit includes information to determine the hole type; and the determining portion determines the hole type from the information included in the punch unit.

10. The image forming system according to claim 7, wherein the controlling portion sets the stack limit number of sheets so that the stack limit number of sheets at a time when a number of the holes is larger than a predetermined number is smaller than that at a time when the number of the holes is smaller than or equal to the predetermined number.

11. The image forming system according to claim 7, wherein the controlling portion sets the stack limit number of sheets so that the stack limit number of sheets at a time when a shape of the hole is square is smaller than that at a time when the shape of the hole is circular.

12. The image forming system according to claim 7, wherein the controlling portion sets the stack limit number of sheets so that the stack limit number of sheets at a time when a size of the hole is smaller than or equal to a predetermined size is smaller than that at a time when the size of the holes is larger than the predetermined size.

* * * * *